US009658547B2

(12) United States Patent
Hara

(10) Patent No.: US 9,658,547 B2
(45) Date of Patent: May 23, 2017

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventor: Satomi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/042,609

(22) Filed: Feb. 12, 2016

(65) Prior Publication Data

US 2017/0090321 A1 Mar. 30, 2017

(30) Foreign Application Priority Data

Sep. 25, 2015 (JP) ..... 2015-188588

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/097*** | (2006.01) |
| *G03G 15/08* | (2006.01) |

(52) U.S. Cl.

CPC ..... *G03G 9/0825* (2013.01); *G03G 9/0827* (2013.01); *G03G 9/08755* (2013.01); *G03G 9/08764* (2013.01); *G03G 9/0926* (2013.01); *G03G 9/09708* (2013.01); *G03G 9/09716* (2013.01); *G03G 15/0865* (2013.01)

(58) Field of Classification Search

CPC ..... G03G 9/09708; G03G 9/08764; G03G 9/09716; G03G 9/0825; G03G 9/0827

USPC ..... 430/108.6

See application file for complete search history.

(56) References Cited

U.S. PATENT DOCUMENTS

2008/0107986 A1* 5/2008 Michel ..... C09C 1/42 430/84
2008/0233497 A1* 9/2008 Yamamoto ..... G03G 9/08702 430/48
2008/0233498 A1* 9/2008 Yamada ..... G03G 9/0804 430/48
2009/0047595 A1* 2/2009 McDougall ..... G03G 9/0804 430/137.14
2009/0280422 A1* 11/2009 Shiokawa ..... G03G 9/09708 430/108.2
2010/0227265 A1* 9/2010 Matsumoto ..... G03G 9/081 430/105

(Continued)

FOREIGN PATENT DOCUMENTS

JP 2014-163996 A 9/2014

OTHER PUBLICATIONS

Diamond, Arthur S (editor) Handbook of Imaging Materials. New York: Marcel-Dekker, Inc. (2002) pp. 145-164.*

(Continued)

*Primary Examiner* — Christopher Rodee
(74) *Attorney, Agent, or Firm* — Oliff PLC

(57) ABSTRACT

A brilliant toner includes a toner particle that includes a binder resin, a flake-shaped brilliant pigment, and a layered inorganic substance, wherein a content of the layered inorganic substance is from 0.005% by weight to 2.0% by weight with respect to the toner particles, and 80% by weight or more of the layered inorganic substance is present in a portion being in a range of 5 nm to 20 nm from a surface of the toner particle.

12 Claims, 2 Drawing Sheets

(56) References Cited

U.S. PATENT DOCUMENTS

| | | | | |
|---|---|---|---|---|
| 2012/0282000 | A1* | 11/2012 | Nakayama | G03G 9/0806 399/130 |
| 2013/0244153 | A1* | 9/2013 | Nakayama | G03G 9/08 430/105 |
| 2014/0045113 | A1* | 2/2014 | Takahashi | G03G 9/08755 430/105 |
| 2014/0234765 | A1 | 8/2014 | Hirai et al. | |

OTHER PUBLICATIONS

Pettersson, Torbjorn et al. "Leveling During Toner Fusing: Effects on Surface Roughness and Gloss of Printed Paper" Journal of Imaging Science and Technology 50(2) pp. 202-215 (2006).*

Briggs, John C et al. "The Effect of Fusing on Gloss in Electrophotography" IS&T's NIP14. Toronto (1998) 6 pages.*

* cited by examiner

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-188588 filed Sep. 25, 2015.

BACKGROUND

1. Technical Field

The present invention relates to a brilliant toner, an electrostatic charge image developer, and a toner cartridge.

2. Related Art

In recent years, for the purpose of forming an image having brilliance similar to metallic luster, the use of brilliant toners including a brilliant pigment has been examined.

SUMMARY

According to an aspect of the invention, there is provided a brilliant toner including:

a toner particle that includes a binder resin, a flake-shaped brilliant pigment, and a layered inorganic substance, wherein a content of the layered inorganic substance is from 0.005% by weight to 2.0% by weight with respect to the toner particles, and 80% by weight or more of the layered inorganic substance is present in a portion being in a range of 5 nm to 20 nm from a surface of the toner particle.

BRIEF DESCRIPTION OF THE DRAWINGS

Exemplary embodiments of the present invention will be described in detail based on the following figures, wherein.

DETAILED DESCRIPTION

Figure 1:
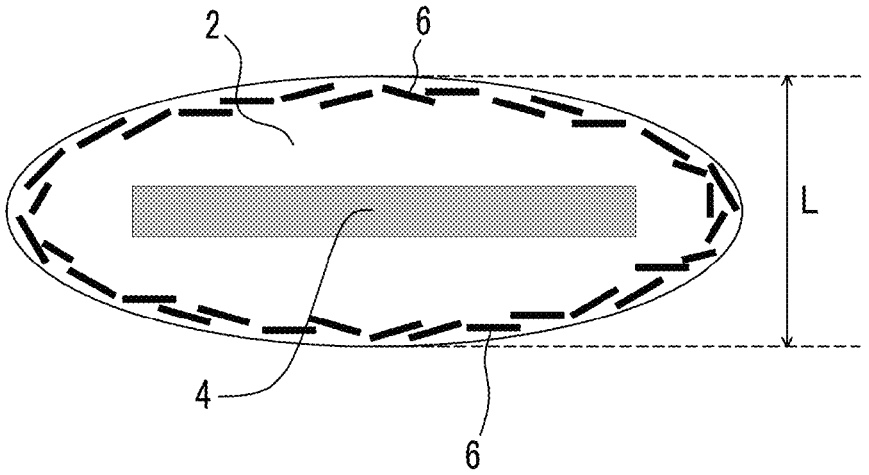
FIG. 1 is a cross-sectional view schematically showing an example of toner particles according to an exemplary embodiment.

Hereinafter, exemplary embodiments as examples of the present invention will be described in detail.

Brilliant Toner

A brilliant toner according to an exemplary embodiment (hereinafter, sometimes referred to as "toner") has a toner particle that includes a binder resin, a flake-shaped brilliant pigment, and a layered inorganic substance. The content of the layered inorganic substance is from 0.005% by weight to 2.0% by weight with respect to the toner particles and 80% by weight or more of the total layered inorganic substance is present in a portion being in a range of 5 nm to 20 nm from the surface of the toner particle.

Since the toner according to the exemplary embodiment has the above configuration, a fixing member is prevented from being damaged by the brilliant pigment. The reason is presumed as follows.

First, brilliance is imparted to a fixed image formed using the brilliant toner having the toner particle including the flake-shaped brilliant pigment and the binder resin. However, when a toner image formed using the brilliant toner is fixed at a contact portion between a fixing member and a pressing member (hereinafter, also referred to as "fixing nip portion"), the surface of the fixing member may be damaged by the flake-shaped brilliant pigment. This phenomenon is considered to occur because due to the brilliant pigment having high hardness and a flake shape, the edge portion of the brilliant pigment protrudes toward the surface of a fixed image or is rubbed with the surface at the time of fixing a toner image. Particularly, when the same image is repeatedly formed, the same portion of the surface of the fixing member is damaged and thus the life of the fixing member is reduced.

Here, 80% by weight or more of the total layered inorganic substance is made to be present in a portion being in a range of 5 nm to 20 nm from the surfaces of the toner particles. That is, the layered inorganic substance is unevenly distributed to the surface layer of the toner particles. When the layered inorganic substance is unevenly distributed to the surface layer of the toner particle, the layered inorganic substance is easily present around the brilliant pigment in the toner particle. Therefore, at the time of fixing a toner image, the layered inorganic substance is interposed between the brilliant pigment and the fixing member and the edge portion of the brilliant pigment is prevented from directly protruding toward the surface of a fixed image or being directly rubbed with the surface. Further, it is considered that since the layered inorganic substance has cleavability, the layered inorganic substance is interposed between the brilliant pigment and the fixing member and thus an impact generated when the edge portion of the brilliant pigment protrudes toward the layered inorganic substance or is rubbed with the layered inorganic substance is easily absorbed. That is, the layered inorganic substance functions as a buffer material between the brilliant pigment and the surface of the fixed image. When the layered inorganic substance is included in the toner particles at a content in the above range, the function is sufficiently exhibited.

When the content of the layered inorganic substance exceeds 2.0% by weight, brilliance may not be obtained and specifically, a ratio (X/Y), which will be described later, is less than 1.2.

From the above, it is presumed that since the toner according to the exemplary embodiment has the above configuration, a fixing member is prevented from being damaged by the brilliant pigment. In addition, when the same image is repeatedly formed, the same portion of the surface of the fixing member is prevented from being damaged and thus the life of the fixing member is prevented from being reduced.

Here, the term "brilliant" in the toner according to the exemplary embodiment indicates that an image has brilliance similar to metallic luster when the image formed by the brilliant toner is visually checked.

Specifically, in the toner according to the exemplary embodiment, when a solid image is formed, a ratio (X/Y) of a reflectance X at a light receiving angle of +30° to a reflectance Y at a light receiving angle of −30°, which are reflectances measured when the image is irradiated with incident light at an incident angle of −45° using a goniophotometer, is preferably from 1.2 to 100.

If the ratio (X/Y) is equal to or greater than 1.2, this indicates that light is reflected more toward a side ("angle+" side) opposite to the light incident side than toward a side ("angle−" side) where the incident light enters, that is, this indicates that diffuse reflection of the incident light is inhibited. When the diffuse reflection in which the incident light is reflected to various directions is caused, if the reflected light is visually checked, colors look blurry. Therefore, when the ratio (X/Y) is less than 1.2, if the reflected light is visually checked, brilliance is not confirmed, thereby causing inferior brilliant properties in some cases.

On the other hand, when the ratio (X/Y) exceeds 100, a viewing angle in which the reflected light may be visually checked is narrowed too much, and specular reflected light components are large. Therefore, a phenomenon in which colors look darkish depending on angles may occur. In addition, it is also difficult to prepare a toner in which the ratio (X/Y) exceeds 100.

The ratio (X/Y) is preferably from 4 to 50 to obtain a brilliance and to prepare a toner, more preferably from 6 to 20, and particularly preferably from 8 to 15.

Measurement of Ratio (X/Y) Using Goniophotometer

First, an incident angle and a light receiving angle will be described. In the exemplary embodiment, when the measurement is performed using a goniophotometer, the incident angle is set to −45°. This is because the sensitivity of the measurement is high with respect to images of a wide range of brilliance.

In addition, the reason why the light receiving angle is set to −30° and +30° is that the sensitivity of the measurement is the highest for evaluating images having and not having the impression of brilliance.

Next, the method of measuring the ratio (X/Y) will be described.

By using a goniospectrocolorimeter GC5000L manufactured by NIPPON DENSHOKU INDUSTRIES CO., LTD. as a goniophotometer, incident light that enters an image to be measured (brilliant image) at an incident angle of −45° enters the image and the reflectance X at a light receiving angle of +30° and the reflectance Y at a light receiving angle of −30° are measured. The reflectances X and Y are measured with respect to light having a wavelength ranging from 400 nm to 700 nm at an interval of 20 nm, and the average value of the reflectance at each wavelength is calculated. The ratio (X/Y) is calculated from the measurement results.

From the viewpoint of satisfying the ratio (X/Y) described above, the toner according to the exemplary embodiment may preferably meet the requirements (1) and (2) below.

(1) The toner has an average equivalent circle diameter D larger than an average maximum thickness C.

(2) When a cross section of the toner in a thickness direction thereof is observed, the number of pigment particles arranged so that an angle formed by a long axis direction of the toner in the cross section and a long axis direction of a pigment particle is in a range of −30° to +30° is equal to or greater than 60% of the total number of pigment particles observed.

When the toner particle has a flake shape having an equivalent circle diameter larger than the thickness (refer to FIG. 1), it is considered that the flake-shaped toner particles are arranged such that the flake surface side of the flake-shaped toner particle faces a surface of a recording medium by the pressure at the time of fixing in a fixing step for image forming. In FIG. 1, the reference numeral 2 represents a toner particle, the reference numeral 4 represents a brilliant pigment, and the reference symbol L represents the thickness of the toner particle.

Accordingly, among the flake-shaped (flaky) brilliant pigment particles contained in the toner particles, brilliant pigment particles that satisfy the requirement "an angle formed by a long axis direction of the toner in the cross section and a long axis direction of a brilliant pigment is in a range of −30° to +30°" described in (2) above are considered to be arranged such that the surface side, which provides the maximum area, faces the surface of the recording medium. When an image formed in this manner is irradiated with light, it is considered that the proportion of pigment particles, which cause diffuse reflection of incident light, is reduced and thus the above-described range of the ratio (X/Y) may be achieved.

Hereinafter, the toner according to the exemplary embodiment will be described in detail.

The toner according to the exemplary embodiment includes toner particles. The toner may include an external additive which is externally added to the toner particles, if necessary.

Toner Particles

The toner particle includes a binder resin, a flake-shaped brilliant pigment, and a layered inorganic substance. The layered inorganic substance is unevenly distributed to the surface layer of the toner particle (refer to FIG. 1). The toner particle may include a release agent and other additives, if necessary. In FIG. 1, the reference numeral 2 represents a toner particle, the reference numeral 4 represents a brilliant pigment, the reference numeral 6 represents a layered inorganic substance, and the reference symbol L represents the thickness of the toner particle.

Binder Resin

Examples of the binder resins include a homopolymer composed of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin as described above, or a graft polymer obtained by polymerizing a vinyl monomer in the presence thereof.

These binder resins may be used singly or in combination with two or more kinds thereof.

A polyester resin is suitable as the binder resin.

As the polyester resin, a well-known polyester resin is used, for example.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and is more preferably from 50° C. to 65° C.

Incidentally, the glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

A weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, which is GPC manufactured by Tosoh Corporation as a measurement device by using TSKGEL Super HM-M (15 cm), which is a column manufactured by Tosoh Corporation. The weight-average molecular weight and the number-average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Here, examples of the polyester resin also include modified polyester resins other than the aforementioned unmodified polyester resin. The modified polyester resin includes a polyester resin in which bonding groups other than an ester bond are present, and a polyester resin in which resin components different from a polyester resin component are bonded by a covalent bond, an ionic bond and the like. Examples of the modified polyester resin include resins in which the end is modified by reaction of a polyester resin into which a functional group such as an isocyanate group reacting with an acid group or a hydroxyl group at the end thereof is introduced, with an active hydrogen compound.

As the modified polyester resin, a urea-modified polyester resin is particularly preferable. When the toner particle includes a urea-modified polyester resin as the binder resin, a fixing member is easily prevented from being damaged by the brilliant pigment. This is because due to improved resin coatability to the brilliant pigment, damage of the fixing member caused by contact with the brilliant pigment is prevented. From this viewpoint, the content of the urea-modified polyester resin is preferably from 5% by weight to 40% by weight and more preferably from 10% by weight to 20% by weight with respect to the total binder resin.

The urea-modified polyester resin may be a urea-modified polyester resin obtained by reaction (at least one of cross-linking reaction and elongation reaction) between a polyester resin having isocyanate groups (polyester prepolymer) and an amine compound. The urea-modified polyester resin may contain a urea bond together with a urethane bond.

As the polyester prepolymer having isocyanate groups, a prepolymer obtained by reacting a polyester which is a polycondensate of a polyvalent carboxylic acid and a polyol and has active hydrogen with a polyisocyanate compound may be used. Examples of an active hydrogen containing group of the polyester include hydroxyl groups (alcoholic hydroxyl group and phenolic hydroxyl group), an amino group, a carboxyl group, and a mercapto group. The alcoholic hydroxyl group is preferable.

In the polyester prepolymer having isocyanate groups, the polyvalent carboxylic acid and the polyol are compounds which are similar to the above examples of the polyvalent carboxylic acid and the polyol mentioned in the description of the polyester resin.

Examples of the polyvalent isocyanate compound include aliphatic polyisocyanates (such as tetramethylene diisocyanate, hexamethylene diisocyanate, and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as $\alpha,\alpha,\alpha',\alpha'$-tetramethylxylylene diisocyanate); isocyanurates; and compounds formed by blocking the above polyisocyanates with a blocking agent such as a phenol derivative, oxime, and caprolactam.

These polyvalent isocyanate compounds may be used alone or in combination of two or more kinds thereof.

The ratio of the polyvalent isocyanate compound is, in terms of an equivalent ratio [NCO]/[OH] between the isocyanate group [NCO] and the hydroxyl group [OH] of the hydroxyl-containing polyester prepolymer, preferably from 1/1 to 5/1, more preferably from 1.2/1 to 4/1, and still more preferably from 1.5/1 to 2.5/1. When the ratio [NCO]/[OH] is from 1/1 to 5/1, a fixing member is easily prevented from being damaged by the brilliant pigment. When the ratio [NCO]/[OH] is 5/1 or less, deterioration of low temperature fixability is easily prevented.

The content of a component derived from the polyvalent isocyanate compound in the polyester prepolymer having isocyanate groups is preferably from 0.5% by weight to 40% by weight, more preferably from 1% by weight to 30% by weight, and still more preferably from 2% by weight to 20% by weight with respect to the total polyester prepolymer having isocyanate groups. When the content of the component derived from the polyvalent isocyanate compound is from 0.5% by weight to 40% by weight, a fixing member is easily prevented from being damaged by the brilliant pigment. When the content of the component derived from the polyvalent isocyanate compound is 40% by weight or less, deterioration of low temperature fixability is easily prevented.

The average number of isocyanate groups contained per molecule of the polyester prepolymer having isocyanate groups is preferably from 1 or more, more preferably from 1.5 to 3, and still more preferably from 1.8 to 2.5. When the number of isocyanate groups per molecule is 1 or more, the molecular weight of the urea-modified polyester resin after reaction increases, and a fixing member is easily prevented from being damaged by the brilliant pigment.

Examples of the amine compound reacting with the polyester prepolymer having isocyanate groups include diamines, tri- or higher-valent polyamines, amino alcohols, amino mercaptans, amino acids, and compounds obtained by blocking these amine groups.

Examples of the diamines include aromatic diamines (such as phenylenediamine, diethyltoluenediamine, and 4,4'-diaminodiphenylmethane), alicyclic diamines (such as 4,4'-diamino-3,3'-dimethyldicyclohexylmethane, diaminecyclohexane, and isophoronediamine); and aliphatic diamines (such as ethylenediamine, tetramethylenediamine, and hexamethylenediamine).

Examples of the tri- or higher-valent polyamines include diethylenetriamine and triethylenetetramine.

Examples of the amino alcohols include ethanolamine and hydroxyethyl aniline.

Examples of the amino mercaptans include aminoethyl mercaptan and aminopropyl mercaptan.

Examples of the amino acids include aminopropionic acid and aminocaproic acid.

Examples of the compounds obtained by blocking these amine groups include ketimine compounds obtained from amine compounds, such as diamines, tri- or higher-valent polyamines, amino alcohols, amino mercaptans, and amino acids, and ketone compounds (such as acetone, methyl ethyl ketone, and methyl isobutyl ketone) and oxazoline compounds.

Among these amine compounds, the ketimine compounds are preferable.

These amine compounds may be used alone or in combination of two or more kinds thereof.

The molecular weight of the urea-modified polyester resin after completion of reaction may be adjusted by adjusting reaction between the polyester resin having isocyanate groups (polyester prepolymer) and the amine compound (at least one of crosslinking reaction and elongation reaction) with a reaction terminator which terminates at least one of crosslinking reaction and elongation reaction (hereinafter, also referred to as "crosslinking/elongation reaction terminator").

Examples of the crosslinking/elongation reaction terminator include monoamines (such as diethylamine, dibutylamine, butylamine, and laurylamine) and blocked compounds thereof (ketimine compounds).

The ratio of the amine compound is, in terms of an equivalent ratio [NCO]/[NHx] between the isocyanate group [NCO] in the polyester prepolymer having isocyanate groups and the amino group [NHx] in the amines, preferably from 1/2 to 2/1, more preferably from 1/1.5 to 1.5/1, and still more preferably from 1/1.2 to 1.2/1. When the [NCO]/[NHx] is in the above range, the molecular weight of the urea-modified polyester resin after completion of reaction increases, and thus a fixing member is easily prevented from being damaged by the brilliant pigment.

The glass transition temperature of the urea-modified polyester resin is preferably from 40° C. to 65° C. and more preferably from 45° C. to 60° C. The number average molecular weight thereof is preferably from 2,500 to 50,000 and more preferably from 2,500 to 30,000. The weight average molecular weight is preferably from 10,000 to 500,000 and more preferably from 30,000 to 100,000.

For example, the content of the binder resin is from 40% by weight to 95% by weight, more preferably from 50% by weight to 90% by weigh, and still more preferably from 60% by weight to 85% by weight with respect to the total toner particles.

Brilliant Pigment

As the brilliant pigment, for example, a pigment (brilliant pigment) that may provide brilliance similar to metallic luster may be used. Specific examples of the brilliant pigment include metal powders such as aluminum (Al element metal), brass, bronze, nickel, stainless steel, and zinc powders; coated foil-shaped inorganic crystalline substrates, such as mica, barium sulfate, layered silicate and layered aluminum silicate coated with titanium oxide or yellow iron oxide; single-crystal planar titanium oxide; basic carbonates; acid bismuth oxychloride; natural guanine; foil-shaped glass powder; and metal-deposited foil-shaped glass powder. The brilliant pigment is not particularly limited as long as the pigment has brilliance.

Among the brilliant pigments, particularly from the viewpoint of mirror surface reflection intensity, metal powders are preferable and among these, aluminum is most preferable.

The brilliant pigment has a flake (flaky) shape.

The average length of the brilliant pigment in a long axis direction is preferably from 1 μm to 30 μm, more preferably from 3 μm to 20 μm, and still more preferably from 5 μm to 15 μm.

The ratio (aspect ratio) between the average length in the long axis direction and the average length in a thickness direction when the average length of the brilliant pigment in the thickness direction is 1, is preferably from 5 to 200, more preferably from 10 to 100, and still more preferably from 30 to 70.

The respective average lengths and the aspect ratio of the brilliant pigment are measured by the following method. A photograph of the pigment particles is captured by using a scanning electron microscope (S-4800, manufactured by Hitachi High Technologies Co., Ltd.), with measurable magnification power (from 300 times to 100,000 times), the length of each particle in the long axis direction and the length thereof in the thickness direction are measured in a two-dimensional state of the obtained image of the pigment particles, and the average length in the long axis direction and the aspect ratio of the brilliant pigment are calculated.

The content of the brilliant pigment is preferably from 1 part by weight to 50 parts by weight and more preferably from 15 parts by weight to 25 parts by weight, with respect to 100 parts by weight of the toner particles.

Layered Inorganic Substance

As the layered inorganic substance, clay minerals and the like may be used. Examples of the clay minerals include montmorillonite, smectite, hydrotalcite, beidellite, nontronite, hectorite, saponite, sauconite, stevensite, bentonite, mica minerals, trioctahedral vermiculite, paragonite, clintonite, and anandite. Among these, as the layered inorganic substance, from the viewpoint of easily preventing a fixing member from being damaged by the brilliant pigment, montmorillonite is preferable.

The layered inorganic substance may be subjected to organic modification by intercalation.

The average length of the layered inorganic substance in a long axis direction is preferably from 0.1 μm to 3 μm, more preferably from 0.5 μm to 2.5 μm, and still more preferably from 1.0 μm to 2.0 μm from the viewpoint of easily preventing a fixing member from being damaged by the brilliant pigment.

The ratio (aspect ratio) between the average length in the long axis direction and the average length in a thickness direction when the average length of the brilliant pigment in the thickness direction is 1 is preferably from 5 to 100, more preferably from 10 to 70, and still more preferably from 30 to 60 from the viewpoint of easily preventing a fixing member from being damaged by the brilliant pigment.

The respective average lengths and the aspect ratio of the layered inorganic substance are measured in the same manner as in the measurement of the respective average lengths and the aspect ratio of the brilliant pigment.

The content of the layered inorganic substance is from 0.005% by weight to 1.2% by weight with respect to the toner particles, and is preferably from 0.01% by weight to 1.0% by weight and more preferably from 0.1% by weight to 0.5% by weight from the viewpoint of easily preventing a fixing member from being damaged by the brilliant pigment.

Regarding the layered inorganic substance, 80% by weight or more of the total layered inorganic substance is present in a portion being in a range of 5 nm to 20 nm from the surfaces of the toner particles (hereinafter, the existence rate of the layered inorganic substance present in a portion being in a range of 5 nm to 20 nm from the surfaces of the toner particles is also referred to as "existence rate of the layered inorganic substance in the surface layer").

The existence rate of the layered inorganic substance in the surface layer is 80% by weight or more. However, from the viewpoint of easily preventing a fixing member from being damaged by the brilliant pigment, the existence rate is preferably 85% by weight or more and more preferably 90% by weight or more. The upper limit of the existence rate of the layered inorganic substance in the surface layer is preferably 100%.

The expression "the layered inorganic substance present in a portion being in a range of 5 nm to 20 nm from the surfaces of the toner particles" indicates that the layered inorganic substance is present in a portion being away from the surface of the toner particle in a depth direction in a range of 5 nm to 20 nm.

The existence rate of the layered inorganic substance in the surface layer is a value measured by the following manner. Using depth X-ray photoelectron spectroscopy (XPS), it is identified that at least two or more elements among elements of Si, Al, and Mg are contained in a portion being in a range of 5 nm to 20 nm from the surface layer of the toner. The existence rate of the layered inorganic substance in the surface layer is calculated from the content ratio between the elements and carbon. More specifically, the existence rate of the layered inorganic substance in the surface layer is calculated as a ratio [(total amount of elements of Si, Al, and Mg)/amount of carbon]. The layered inorganic substance includes oxygen and toner particles constituting materials such as a binder resin, a release agent, and a coloring agent (such as a pigment) include elements in addition to carbon. However, the ratio is set to the existence rate of the layered inorganic substance in the surface layer.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight and more preferably from 5% by weight to 15% by weight, with respect to the entirety of the toner particles.

Other Additives

Examples of the additive include known additives such as a magnetic substance, a charge-controlling agent, an inorganic power, and other colorant than the brilliant pigment. These additives may be incorporated into a toner particle as an inner additive.

Examples of the charge-controlling agent include quaternary ammonium salt compounds, nigrosine compounds, dyes containing a complex of aluminum, iron, chromium, or the like, and triphenylmethane-based pigments.

Examples of the inorganic particles include known inorganic particles such as silica particles, titanium oxide particles, alumina particles, cerium oxide particles, and particles obtained by hydrophobizing the surfaces of these particles. These inorganic particles may be used alone or in combinations of two or more kinds thereof. Among these inorganic particles, silica particles, which have a refractive index lower than that of the above-described binder resin, are preferably used. The silica particles may be subjected to various surface treatments. For example, silica particles surface-treated with a silane coupling agent, a titanium coupling agent, silicone oil, or the like are preferably used.

Examples of coloring agents other than the brilliant pigment include known coloring agents and the coloring agent is selected according to a target color. As the coloring agents, if necessary, a surface-treated coloring agent may be used or the coloring agent may be used in combination together with a dispersant.

Characteristics of Toner Particles

The toner particles may be toner particles having a single layer structure, or may be toner particles having a so-called core/shell structure composed of a core (core particle) and a coating layer (shell layer) coated on the core.

The toner particles having a core/shell structure may be composed of, for example, a core containing a brilliant pigment, a binder resin, and if necessary, other additives such as a release agent, and a coating layer containing a binder resin.

Average Maximum Thickness C and Average Equivalent-Circle Diameter D

The flake shape toner is preferable and the toner preferably has the average equivalent-circle diameter D larger than the average maximum thickness C thereof. Moreover, the ratio (C/D) of the average maximum thickness C to the average equivalent-circle diameter D is preferably in a range of from 0.001 to 0.500, more preferably in a range of from 0.001 to 0.200, further preferably in a range of from 0.010 to 0.200, and particularly preferably in a range of from 0.050 to 0.100.

When the ratio (C/D) is 0.001 or more, the strength of the toner may be ensured, and breakage of the toner due to a stress during image formation may be suppressed. Thus, a decrease in charges, the decrease being caused by exposure of the pigment, and fogging caused as a result thereof may be suppressed. On the other hand, when the ratio (C/D) is 0.500 or less, a good brilliance may be obtained.

The average maximum thickness C and the average equivalent-circle diameter D are measured by the methods below.

Toner particles are placed on a smooth surface and uniformly dispersed by applying vibrations. One thousand toner particles are observed with a color laser microscope "VK-9700" (manufactured by Keyence Corporation) at a magnification of 1000 times to measure the maximum thickness C and the equivalent-circle diameter D of a surface viewed from the top, and the arithmetic averages thereof are calculated to determine the average maximum thickness C and the average equivalent-circle diameter D.

Angle Formed by Long Axis Direction of Toner in Cross Section and Long Axis Direction of Pigment Particles As described in (2) above, when a cross section of a toner in the thickness direction thereof is observed, the number of pigment particles arranged so that an angle formed by a long axis direction of the toner in the cross section and a long axis direction of a pigment particle is in the range of −30° to +30° is preferably 60% or more of the total number of pigment particles observed. Furthermore, the number is more preferably from 70% to 95%, and particularly preferably from 80% to 90%.

When the above number is 60% or more, a good brilliance may be obtained.

Herein, a method of observing a cross section of a toner will be described.

A toner particle is embedded using a bisphenol A type liquid epoxy resin and a hardening agent and then, a cutting sample is prepared. Thereafter, the cutting sample is cut by means of a cutter using a diamond knife, for example, an ultramicrotome device (Ultracut UCT, manufactured by Leica), at −100° C. to prepare an observation sample. This observation sample is observed by an apparatus capable of TEM observation, for example, an ultrahigh resolution field-emission scanning electron microscope (S-4800, manufactured by Hitachi High-Technologies Corporation), at a magnification enough to observe approximately from 1 to 10 toner particles in one visual field.

With respect to the observed 100 toner particles, the number of pigment particles arranged so that the angle formed by the long axis direction of a toner in the cross section and the long axis direction of a pigment particle is in the range of −30° to +30° is counted using image analysis software, example of the analysis software WinRoof (manufactured by MITANI CORPORATION), or using a protractor with an image of the observation sample and the proportion thereof is calculated.

The term "long axis direction of toner in the cross section" refers to a direction orthogonal to a thickness direction of toner having an average equivalent-circle diameter D larger than the average maximum thickness C, and the term "long axis direction of a pigment particle" refers to a length direction of the pigment particle.

The volume average particle diameter of the toner according to the exemplary embodiment is preferably from 1 μm to 30 μm, more preferably from 3 μm to 20 μm, and further preferably from 5 μm to 10 μm.

The volume average particle diameter D50v is determined as follows. A cumulative volume distribution curve and a cumulative number distribution curve are drawn from the smaller particle diameter end, respectively, for each particle diameter range (channel) divided on the basis of a particle diameter distribution measured with a measuring instrument such as a COULTER MULTISIZER II (manufactured by Beckman Coulter Inc.). The particle diameter providing 16% accumulation is defined as that corresponding to volume D16v and number D16p, the particle diameter providing 50% accumulation is defined as that corresponding to volume D50v and number D50p, and the particle diameter providing 84% accumulation is defined as that corresponding to volume D84v and number D84p. The volume average particle diameter distribution index (GSDv) is calculated as $(D84v/D16v)^{1/2}$ using these values.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $CaCO_3$, $MgCO_3$, $BaSO_4$, and $MgSO_4$.

The surfaces of the inorganic particles used as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin) and a cleaning aid (for example, metal salt of higher fatty acid represented by zinc stearate, and fluorine polymer particles).

The amount of the external additive externally added is, for example, preferably from 0.01% by weight to 5% by weight and more preferably from 0.01% by weight to 2.0% by weight, with respect to the toner particles.

Toner Preparing Method

Next, a method of preparing a toner according to the exemplary embodiment will be described.

The toner according to the exemplary embodiment is obtained by preparing toner particles including the brilliant pigment and then externally adding an external additive to the toner particles.

The toner particles may be prepared using any of a dry method (for example, a kneading and pulverizing method) and a wet method (for example, an aggregation and coalescence method, a suspension and polymerization method, and a dissolution and suspension method). The toner particle preparing method is not particularly limited to these methods, and a known method is employed.

For example, the dissolution and suspension method is a method of forming toner particles including: dispersing a liquid, formed by dissolving or dispersing toner particle constituting materials (such as resin particles and a brilliant pigment) in an organic solvent in which a binder resin is soluble, in an aqueous solvent containing a particle dispersant, and then removing the organic solvent. In the dissolution and suspension method, for example, when toner particles are formed in an aqueous solvent, a liquid formed by dissolving or dispersing toner particle constituting materials (such as resin particles and a brilliant pigment) in an organic solvent and a layered inorganic substance are dispersed in an aqueous solvent. A liquid formed by dissolving or dispersing toner particle constituting materials (such as resin particles and a brilliant pigment) and a layered inorganic substance in an organic solvent in advance may be dispersed in an aqueous solvent. Since the layered inorganic substance is highly hydrophilic, the layered inorganic substance is unevenly distributed to the outer side of the toner particles at the time of forming the toner particles.

In addition, an emulsion aggregating method is a method of obtaining toner particles through an aggregation step of forming aggregates of toner particle constituting materials (such as resin particles and a brilliant pigment), and a coalescence step of coalescing the aggregates. In the emulsion aggregating method, aggregates of toner particle constituting materials (such as resin particles and a brilliant pigment) are set as first aggregates, second aggregates are further formed by aggregating resin particles and a layered inorganic substance on the surfaces of the first aggregates, and then the second aggregates are coalesced. Further, aggregates of resin particles may be formed on the surfaces of the second aggregates as third aggregates and then the third aggregates may be coalesced.

Among these, toner particles including a urea-modified polyester resin as the binder resin may be obtained by the dissolution and suspension method shown below. In the following description of the dissolution and suspension method, a method of obtaining toner particles including a release agent is described but the release agent is incorporated in the toner particles, if necessary. In addition, a method of obtaining toner particles including an unmodified polyester resin and a urea-modified polyester resin as binder resins will be described but the toner particles may include only the urea-modified polyester resin as a binder resin.

Oil Phase Liquid Preparation Step

An oil phase liquid obtained by dissolving or dispersing toner particle materials including an unmodified polyester resin, a polyester prepolymer having isocyanate groups, an amine compound, a brilliant pigment, a layered inorganic substance, and a release agent in an organic solvent is prepared (oil phase liquid preparation step). The oil phase liquid preparation step is a step of obtaining a mixed solution of toner materials by dissolving or dispersing the toner particle materials in the organic solvent.

The oil phase liquid may be prepared by methods such as 1) a preparation method of collectively dissolving or dispersing toner materials in an organic solvent, 2) a preparation method of kneading toner materials in advance, and then dissolving or dispersing the kneaded material in an organic solvent, 3) a preparation method of dissolving an unmodified polyester resin, a polyester prepolymer having isocyanate groups, and an amine compound in an organic solvent, and then dispersing a brilliant pigment, a layered inorganic substance, and a release agent in the organic solvent, 4) a preparation method of dispersing a brilliant pigment, a layered inorganic substance, and a release agent in an organic solvent, and then dissolving an unmodified polyester resin, a polyester prepolymer having isocyanate groups, and an amine compound in the organic solvent, 5) a preparation method of dissolving or dispersing toner particle materials (an unmodified polyester resin, a brilliant pigment, a layered inorganic substance, and a release agent), other than a polyester prepolymer having isocyanate groups and an amine compound, in an organic solvent, and then dissolving the polyester prepolymer having isocyanate groups and the amine compound in the organic solvent, and 6) a preparation method of dissolving or dispersing toner particle materials (an unmodified polyester resin, a brilliant pigment, a layered inorganic substance, and a release agent), other than a polyester prepolymer having isocyanate groups or an amine compound, in an organic solvent, and then dissolving the polyester prepolymer having isocyanate groups or the amine compound in the organic solvent. The method of preparing the oil phase liquid is not limited thereto. In addition, the layered inorganic substance may be added to a water phase liquid with an oil phase liquid, which will be described later, when a suspension is obtained by adding the oil phase liquid to the water phase liquid.

Examples of the organic solvent of the oil phase liquid include ester solvents such as methyl acetate and ethyl acetate; ketone solvents such as methyl ethyl ketone and methyl isopropyl ketone; aliphatic hydrocarbon solvents such as hexane and cyclohexane, and halogenated hydrocarbon solvents such as dichloromethane, chloroform, and trichloroethylene. These organic solvents are preferably capable of dissolving therein the binder resin, preferably have a water solubility of about from 0% by weight to 30% by weight, and have a boiling temperature of 100° C. or lower. Among these organic solvents, ethyl acetate is preferable.

Suspension Preparation Step

Next, the obtained oil phase liquid is dispersed in a water phase liquid to prepare a suspension (suspension preparation step).

Reaction between the polyester prepolymer having isocyanate groups and the amine compound is conducted with preparation of the suspension. Then, a urea-modified polyester resin is formed by the reaction. This reaction accompanies at least one of crosslinking reaction and elongation reaction in a molecular chain. The reaction between the polyester prepolymer having isocyanate groups and the amine compound may be conducted with an organic solvent removal step, which will be described later.

Here, the reaction conditions are selected according to reactivity between the isocyanate group structure of the polyester prepolymer and the amine compound. For example, the reaction time is preferably from 10 minutes to 40 hours and more preferably from 2 hours to 24 hours. The reaction temperature is preferably from 0° C. to 150° C. and more preferably from 40° C. to 98° C. For the formation of the urea-modified polyester resin, if necessary, known catalysts (such as dibutyltin laurate and dioctyltin laurate) may be used. That is, a catalyst may be added to the oil phase liquid or the suspension.

Examples of the water phase liquid include water phase liquids in which a particle dispersant such as an organic particle dispersant or an inorganic particle dispersant is dispersed in an aqueous solvent. Examples of the water phase liquid also include water phase liquids in which a particle dispersant is dispersed in an aqueous solvent and a polymer dispersant is dispersed in the aqueous solvent. Known additives such as a surfactant may be added to the water phase liquid.

The aqueous solvent may be water (for example, generally, ion exchange water, distilled water, and pure water). The aqueous solvent may be a solvent including an organic solvent such as alcohols (such as methanol, isopropyl alcohol, and ethylene glycol), dimethylformamide, tetrahydrofuran, cellosolves (such as methyl cellosolve), or lower ketones (such as acetone, and methyl ethyl ketone), together with water.

Examples of the organic particle dispersant include hydrophilic organic particle dispersants. Examples of the organic particle dispersant include particles of alkyl poly (meth)acrylate resin (for example, polymethyl methacrylate resin), polystyrene resin, poly(styrene-acrylonitrile) resin, and polystyrene acryl resin. Examples of the organic particle dispersant also include particles of styrene acrylic resin.

Examples of the inorganic particle dispersant include hydrophilic inorganic particle dispersants. Specific examples of the inorganic particle dispersant include particles of silica, alumina, titania, calcium carbonate, magnesium carbonate, tricalcium phosphate, clay, diatomaceous earth, and bentonite and particles of calcium carbonate are preferable. The inorganic particle dispersants may be used alone or in combination of two or more kinds thereof.

The surface of the particle dispersant may be surface-treated with a polymer having a carboxyl group.

Examples of the polymer having a carboxyl group include copolymers of an α,β-monoethylenically unsaturated carboxylic acid or at least one selected from salts (such as alkali metal salts, alkaline earth metal salts, ammonium salts, and amine salts) obtained by neutralizing the carboxyl group of an α,β-monoethylenically unsaturated carboxylic acid with an alkali metal, an alkaline earth metal, ammonium or amine, and an α,β-monoethylenically unsaturated carboxylic ester. Examples of the polymer having a carboxyl group also include salts (such as alkali metal salts, alkaline earth metal salts, ammonium salts and amine salts) obtained by neutralizing the carboxyl group of a copolymer of an α,β-monoethylenically unsaturated carboxylic acid and an α,β-monoethylenically unsaturated carboxylic ester with an alkali metal, an alkaline earth metal, ammonium or amine. The polymers having a carboxyl group may be used alone or in combination of two or more kinds thereof.

Representative examples of the α,β-monoethylenically unsaturated carboxylic acid include α,β-unsaturated monocarboxylic acids (such as acrylic acid, methacrylic acid, and crotonic acid), and α,β-unsaturated dicarboxylic acids (such as maleic acid, fumaric acid, and itaconic acid). In addition, representative examples of the α,β-monoethylenically unsaturated carboxylic ester include alkyl esters of (meth) acrylic acid, (meth)acrylates having an alkoxy group, (meth) acrylates having a cyclohexyl group, (meth)acrylates having a hydroxy group, and polyalkylene glycol mono(meth) acrylates.

Examples of the polymer dispersant include hydrophilic polymer dispersants. Specific examples of the polymer dispersant include polymer dispersants having a carboxyl group and not having a lipophilic group (such as a hydroxypropoxy group or a methoxy group) (for example, water-soluble cellulose ethers such as carboxymethyl cellulose, and carboxyethyl cellulose).

Solvent Removal Step

Next, a toner particle dispersion is obtained by removing the organic solvent from the obtained suspension (solvent removal step). In the solvent removal step, toner particles are formed by removing the organic solvent included in the liquid droplets of the water phase liquid dispersed in the suspension. The organic solvent removal from the suspension may be performed immediately after the suspension preparation step, but may be performed when at least one minute has passed after the completion of the suspension preparation step.

In the solvent removal step, the organic solvent may be removed from the suspension by cooling or heating the obtained suspension to, for example, a range of 0° C. to 100° C.

As a specific method of removing the organic solvent, the following methods may be used.

(1) A method in which air is blown into the suspension to forcibly renew the gas phase on the surface of the suspension. In this case, a gas may be blown into the suspension.

(2) A method in which the pressure is reduced. In this case, the gas phase on the surface of the suspension may be forcibly renewed by purging with a gas or moreover, a gas may be blown into the suspension.

Toner particles are obtained through the above steps.

Here, after the completion of the solvent removal step, toner particles formed in the toner particle dispersion are subjected to known steps including a washing step, a solid-liquid separation step, and a drying step and thus dry toner particles are obtained.

The washing step may be performed by sufficient substitution and washing with ion exchange water from the viewpoint of charging properties.

In addition, the solid-liquid separation step is not particularly limited and suction filtration, pressure filtration, and the like may be performed from the viewpoint of productivity. In addition, the drying step is not particularly limited and from the viewpoint of productivity, freeze-drying, flush-jet drying, fluidized drying, or vibrating fluidized drying may be performed.

Then, the toner according to the exemplary embodiment may be prepared by adding an external additive to the obtained dry toner particles and mixing the materials.

The mixing may be performed by using a V blender, a Henschel mixer, a ready-gel mixer, and the like.

Further, if necessary, coarse toner particles may be removed by using a vibration classifier, a wind classifier, and the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that stores the electrostatic charge image developer according to this exemplary embodiment and is provided with a developing unit is preferably used.

Hereinafter, an example of the image forming apparatus according to this exemplary embodiment will be shown. However, the image forming apparatus is not limited thereto. Main portions shown in the drawing will be described, but descriptions of other portions will be omitted.

Figure 2:
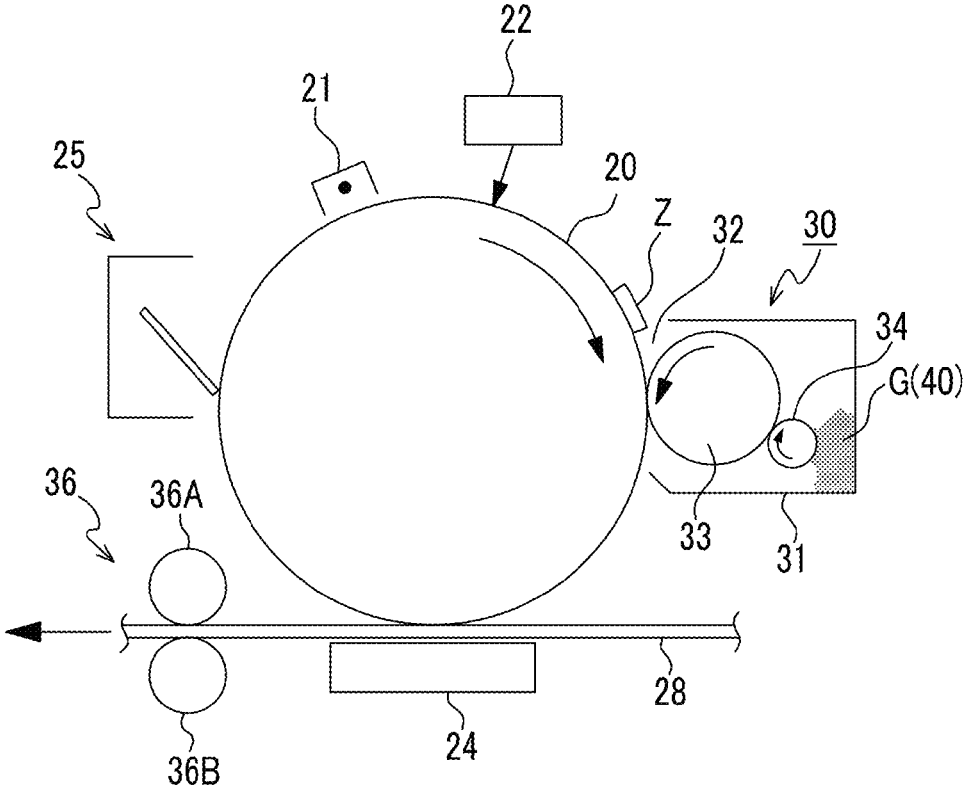
FIG. 2 is a schematic configuration diagram showing an example of an image forming apparatus according to an exemplary embodiment.

FIG. 2 is a schematic configuration diagram showing an exemplary embodiment of an image forming apparatus including a developing device to which the electrostatic charge image developer according to the exemplary embodiment is applied.

In the drawing, the image forming apparatus according to the exemplary embodiment has a photoreceptor drum 20 as an image holding member that rotates in a predetermined direction, and a charging device 21 that charges the photoreceptor drum 20, an exposing device 22, for example, as an electrostatic charge image forming device that forms an electrostatic charge image Z on the photoreceptor drum 20, a developing device 30 that visualizes the electrostatic charge image Z formed on the photoreceptor drum 20, a transfer device 24 that transfers the visualized toner image on the photoreceptor drum 20 onto recording paper 28 as a recording medium, and a cleaning device 25 that cleans the toner remaining on the photoreceptor drum 20 are sequentially arranged around the photoreceptor drum 20.

In the exemplary embodiment, as shown in FIG. 2, the developing device 30 includes a developing housing 31 that stores a developer G containing a toner 40. In the developing housing 31, an opening 32 for developing facing the photoreceptor drum 20 is opened, and a developing roll (developing electrode) 33 as a toner holding member facing the opening 32 for developing is disposed. When a predetermined developing bias is applied to the developing roll 33, an electric field of developing is formed in an area (developing area) which is an area interposed between the photoreceptor drum 20 and the developing roll 33. In addition, a charge injecting roll (injecting electrode) 34 as a charge injecting member that faces the developing roll 33 is disposed in the developing housing 31. Particularly, in the exemplary embodiment, the charge injecting roll 34 also functions as a toner supplying roll that supplies the toner 40 to the developing roll 33.

Herein, the rotation direction of the charge injecting roll 34 may or may not be particularly determined. However, in consideration of the properties relating to the supply of the toner and the characteristics relating to the injection of charge, a constitution is preferable in which the charge injecting roll 34 rotates in the same direction and with a circumferential speed difference (for example, equal to or more than 1.5 times) in a portion facing the developing roll 33 such that the toner 40 is inserted into the area interposed between the charge injecting roll 34 and the developing roll 33, and injects charge while sliding.

Next, the operation of the image forming apparatus according to the exemplary embodiment will be described.

When an image forming process begins, first, the surface of the photoreceptor drum 20 is charged by the charging device 21, the exposing device 22 writes the electrostatic charge image Z on the charged photoreceptor drum 20, and the developing device 30 visualizes the electrostatic charge image Z as a toner image. Subsequently, the toner image on the photoreceptor drum 20 is transported to a transfer position, and the transfer device 24 electrostatically transfers the toner image on the photoreceptor drum 20 to the recording paper 28 as a recording medium. The residual toner on the photoreceptor drum 20 is cleaned by the cleaning device 25. Thereafter, the toner image is fixed on the recording paper 28 by a fixing device 36 provided with a fixing member 36A (a fixing belt, a fixing roll, and the like) and a pressing member 36B and thus an image is obtained.

Process Cartridge/Toner Cartridge

A process cartridge according to this exemplary embodiment will be described.

The process cartridge according to this exemplary embodiment is provided with a developing unit that stores the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 3:
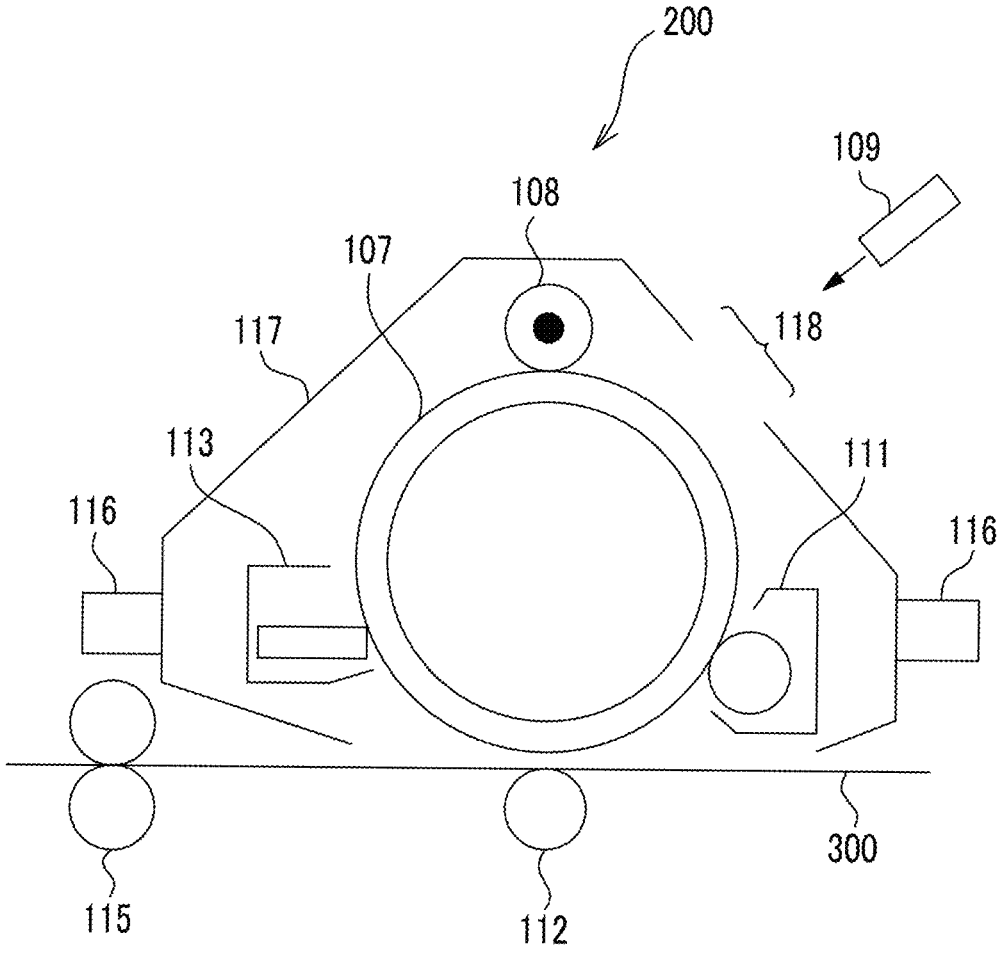
FIG. 3 is a schematic configuration diagram showing an example of a process cartridge according to an exemplary embodiment.

FIG. 3 is a schematic diagram showing a configuration of the process cartridge according to this exemplary embodiment.

A process cartridge 200 shown in FIG. 3 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment may be configured to store the toner according to the exemplary embodiment and be detachable from an image forming apparatus. The toner cartridge according to the exemplary embodiment may store at least toner and may store, for example, a developer according to the configuration of the image forming apparatus. The toner cartridge according to the exemplary embodiment may store the toner in a storing portion.

The image forming apparatus shown in FIG. 2 has a configuration in which a toner cartridge (not shown in the drawing) is detached from the apparatus. The developing device 30 is connected to the toner cartridge through a toner supply tube not shown in the drawing. In addition, when there is little toner stored in the toner cartridge, the toner cartridge may be replaced.

EXAMPLES

Hereinafter, the exemplary embodiment will be described in detail with reference to examples but the exemplary embodiment is not limited to these examples. In the following description, unless specified otherwise, "part (s)" and "%" are all based on weight.

Example A: Example of Brilliant Toner Using Urea-Modified Polyester Resin

Preparation of Unmodified Polyester Resin (A1)

| | |
|---|---|
| Terephthalic acid: | 1,243 parts |
| Ethylene oxide adduct of Bisphenol A: | 1,830 parts |
| Propylene oxide adduct of Bisphenol A: | 840 parts |

The above components are mixed and heated at 180° C., and then 3 parts of dibutyltin oxide is added thereto. The mixture is heated at 220° C. to distill away water, and thus an unmodified polyester resin is obtained. The glass transition temperature Tg of the obtained unmodified polyester resin is 60° C., the acid value is 3 mgKOH/g, and the hydroxyl value is 1 mgKOH/g.

Preparation of Polyester Prepolymer (A1)

| | |
|---|---|
| Terephthalic acid: | 1,243 parts |
| Ethylene oxide adduct of Bisphenol A: | 1,830 parts |
| Propylene oxide adduct of Bisphenol A: | 840 parts |

The above components are mixed and heated at 180° C., and then 3 parts of dibutyltin oxide is added thereto. The mixture is heated at 220° C. to distill away water, and thus a polyester prepolymer is obtained. 350 parts of the obtained polyester prepolymer, 50 parts of tolylene diisocyanate, and 450 parts of ethyl acetate are put into a container, and the mixture is heated to 130° C. for 3 hours. Thus, a polyester prepolymer (A1) having isocyanate groups (hereinafter, referred to as "isocyanate-modified polyester prepolymer (A1)") is obtained.

Preparation of Ketimine Compound (A1)

50 parts of methyl ethyl ketone and 150 parts of hexamethylenediamine are put into a container and stirred at 60° C. to obtain a ketimine compound (A1).

Preparation of Brilliant Pigment Dispersion (A1)

| | |
|---|---|
| Aluminum pigment (flake-shaped brilliant pigment, 2173EA, manufactured by Showa Aluminum Powder K.K.): | 100 parts |
| Ethyl acetate: | 500 parts |

The above components are mixed, the mixture is filtered, and 500 parts of ethyl acetate is further mixed. This operation is repeated 5 times and then the resultant mixture is dispersed using an emulsification dispersing machine CAVITRON (CR1010, manufactured by Pacific Machinery & Engineering Co., Ltd.) for about 1 hour. Thus, a brilliant pigment dispersion (A1) (solid content concentration: 10%) in which a brilliant pigment (aluminum pigment) is dispersed is obtained.

Preparation of Release Agent Dispersion (A1)

| | |
|---|---|
| Paraffin wax (melting temperature: 89° C.): | 30 parts |
| Ethyl acetate: | 270 parts |

The above components are wet-pulverized by a microbead disperser (DCP mill) in a state of being cooled to 10° C. to obtain a release agent dispersion (A1).

Preparation of Oil Phase Liquid (A1)

| | |
|---|---|
| Unmodified polyester resin (A1): | 136 parts |
| Brilliant pigment dispersion (A1): | 500 parts |
| Ethyl acetate: | 56 parts |

The above components are stirred and mixed, and then 75 parts of the release agent dispersion (A1) is added to the obtained mixture, followed by stirring. Thus, an oil phase liquid (A1) is obtained.

Preparation of Styrene Acryl Resin Particle Dispersion (A1)

| | |
|---|---|
| Styrene: | 370 parts |
| n-Butyl acrylate: | 30 parts |
| Acrylic acid: | 4 parts |
| Dodecanthiol: | 24 parts |
| Carbon tetrabromide: | 4 parts |

A mixture obtained by mixing and dissolving the above components is dispersed in an aqueous solution in which 6 parts of a nonionic surfactant (Nonipol 400, manufactured by Sanyo Chemical Industries, Ltd.) and 10 parts of an anionic surfactant (NEOGEN SC, manufactured by DAI-ICHI KOGYO SEIYAKU CO., LTD.) are dissolved in 560 parts of ion exchange water, and the dispersion is emulsified in a flask. Then, while mixing the components for 10 minutes, an aqueous solution in which 4 parts of ammonium persulphate is dissolved in 50 parts of ion exchange water is added thereto, and the flask is purged with nitrogen. Then, the content in the flask is heated in an oil bath, while stirring, until the temperature reaches 70° C., and allowed to perform emulsion polymerization for 5 hours. Thus, a styrene acryl resin particle dispersion (A1) obtained by dispersing resin particles having an average particle diameter of 180 nm and a weight average molecular weight (Mw) of 15,500 (resin particle concentration: 40% by weight) is obtained. The glass transition temperature of the styrene acryl resin particles is 59° C.

Preparation of Water Phase Liquid (A1)

| | |
|---|---|
| Styrene acryl resin particle dispersion (A1): | 60 parts |
| 2% Aqueous CEROGEN BS-H solution (manufactured by DAI-ICHI KOGYO SEIYAKU CO., LTD.): | 200 parts |
| Ion exchange water: | 200 parts |

The above components are stirred and mixed to obtain a water phase liquid (A1).

Preparation of Layered Inorganic Substance Dispersion (A1)

| | |
|---|---|
| Montmorillonite (layered inorganic substance, trade name: "NANOCLAY NANOMER 1.28E", manufactured by Sigma-Aldrich Corporation, average length in long axis direction = 2.0 μm, aspect ratio = 30 to 60): | 50 parts |
| Ethyl acetate: | 50 parts |

The above components are mixed, the mixture is filtered, and 50 parts of ethyl acetate is further mixed. This operation is repeated 5 times and then the mixture is dispersed using an emulsification dispersing machine CAVITRON (CR 1010, manufactured by Pacific Machinery & Engineering Co., Ltd.) for about 1 hour. Thus, a layered inorganic substance dispersion (A1) (solid content concentration: 33.3%) in which the layered inorganic substance (montmorillonite) is dispersed is obtained.

Preparation of Layered Inorganic Substance Dispersion (A2)

A layered inorganic substance dispersion (A2) is obtained in the same manner as in the preparation of the layered inorganic substance dispersion (A1) except that montmorillonite used in the layered inorganic substance dispersion (A1) is treated with a 1.0% silicone oil.

Example A1

Preparation of Toner Particles (A1)

| | |
|---|---|
| Oil phase liquid (A1): | 300 parts |
| Isocyanate-modified polyester prepolymer (A1): | 150 parts |
| Ketimine compound (A1): | 10 parts |
| Layered inorganic substance dispersion (A1): | 28.2 parts |

The above components are put into a container and stirred for 2 minutes with a homogenizer (ULTRA TURRAX, manufactured by IKA) and thus an oil phase liquid (A1P) is obtained. Then, 1,000 parts of the water phase liquid (A1) is added into the container and the components are stirred for 20 minutes with the homogenizer. Next, the mixed solution is stirred for 48 hours at room temperature (25° C.) and normal pressure (1 atmosphere) with a propeller-type stirrer, the isocyanate-modified polyester prepolymer (A1) is allowed to react with the ketimine compound (A1) to forma urea-modified polyester resin, and the organic solvent is removed to form a particulate material. Next, the particulate material is washed with water, dried and classified to obtain toner particles (A1). The volume average particle diameter of the toner particles is 12 μm.

Preparation of Brilliant Toner (A1)

100 parts of the toner particles (A1), 1.5 parts of hydrophobic silica (RY50, manufactured by Nippon Aerosil Co. Ltd.), and 1.0 part of hydrophobic titanium oxide (T805, manufactured by Nippon Aerosil Co. Ltd.) are mixed using a sample mill at 10,000 rpm for 30 seconds. Then, the resultant is sieved with a vibration sieve having an opening of 45 μm to obtain a brilliant toner (A1). The existence rate in the surface layer of montmorillonite is 91%.

Example A2

Toner particles (A2) are obtained in the same manner as in the preparation of the toner particles (A1) except that the layered inorganic substance dispersion (A1) in the preparation of the toner particles (A1) is changed to the layered inorganic substance dispersion (A2).

A brilliant toner (A2) is obtained in the same manner as in the preparation of the brilliant toner (A1) except that the toner particles (A2) are used. The existence rate of montmorillonite in the surface layer is 82%.

Example A3

Toner particles (A3) are obtained in the same manner as in the preparation of the toner particles (A1) except that the amount of the layered inorganic substance dispersion (A1) in the preparation of the toner particles (A1) is changed to 14.1 parts.

A brilliant toner (A3) is obtained in the same manner as in the preparation of the brilliant toner (A1) except that the toner particles (A3) are used. The existence rate of montmorillonite in the surface layer is 92%.

Example A4

Toner particles (A4) are obtained in the same manner as in the preparation of the toner particles (A1) except that the amount of the layered inorganic substance dispersion (A2) in the preparation of the toner particles (A2) is changed to 14.1 parts.

A brilliant toner (A4) is obtained in the same manner as in the preparation of the brilliant toner (A1) except that the toner particles (A4) are used. The existence rate of montmorillonite in the surface layer is 81%.

Example A5

Toner particles (A5) are obtained in the same manner as in the preparation of the toner particles (A1) except that the amount of the layered inorganic substance dispersion (A1) in the preparation of the toner particles (A1) is changed to 0.071 parts.

A brilliant toner (A5) is obtained in the same manner as in the preparation of the brilliant toner (A1) except that the toner particles (A5) are used. The existence rate of montmorillonite in the surface layer is 94%.

Example A6

Toner particles (A6) are obtained in the same manner as in the preparation of the toner particles (A1) except that the amount of the layered inorganic substance dispersion (A2) in the preparation of the toner particles (A2) is changed to 0.071 parts.

A brilliant toner (A6) is obtained in the same manner as in the preparation of the brilliant toner (A1) except that the toner particles (A6) are used. The existence rate of montmorillonite in the surface layer is 83%.

Comparative Example A1

Comparative toner particles (A1) are obtained in the same manner as in the preparation of the toner particles (A1) except that the amount of the layered inorganic substance dispersion (A2) in the preparation of the toner particles (A2) is changed to 31 parts.

A comparative brilliant toner (A1) is obtained in the same manner as in the preparation of the brilliant toner (A1) except that the comparative toner particles (A1) are used. The existence rate of montmorillonite in the surface layer is 78%.

Comparative Example A2

Comparative toner particles (A2) are obtained in the same manner as in the preparation of the toner particles (A1) except that the amount of the layered inorganic substance dispersion (A1) in the preparation of the toner particles (A1) is changed to 0.014 parts.

A comparative brilliant toner (A2) is obtained in the same manner as in the preparation of the brilliant toner (A1) except that the comparative toner particles (A2) are used. The existence rate of montmorillonite in the surface layer is 95%.

Example A7

Toner particles (A7) are obtained in the same manner as in the preparation of the toner particles (A1) except that the layered inorganic substance used in the preparation of the toner particles (A1) is changed to hydrotalcite (ALKAMIZER, manufactured by Kyowa Chemical Industry Co., Ltd., average particle diameter: 0.62 μm).

A brilliant toner (A7) is obtained in the same manner as in the preparation of the brilliant toner (A1) except that the toner particles (A7) are used. The existence rate of hydrotalcite in the surface layer is 85%.

Example B: Example of Brilliant Toner Prepared by Emulsion Aggregating Method

Preparation of Unmodified Polyester Resin (B1)

| | |
|---|---|
| Dimethyl adipate: | 74 parts |
| Dimethyl terephthalate: | 192 parts |
| Ethylene oxide adduct of Bisphenol A: | 216 parts |
| Ethylene glycol: | 38 parts |
| Tetrabutoxy titanate (catalyst): | 0.037 parts |

The above components are put in a two-neck flask and dried by heating, nitrogen gas is put into the container to maintain an inert gas atmosphere, and the temperature is raised under stirring. Thereafter, a copolycondensation reaction is caused at 160° C. for 7 hours, and then the temperature is raised to 220° C. while the pressure is slowly reduced to 10 Torr, and the temperature is held for 4 hours. The pressure is temporarily returned to normal pressure, and then 9 parts of trimellitic anhydride is added. The pressure is then slowly reduced again to 10 Torr, and the temperature is held at 220° C. for 1 hour, thereby synthesizing a polyester resin (B1).

The glass transition temperature (Tg) of the polyester resin (B1) is 63.5° C.

Preparation of Resin Particle Dispersion (B1)

| | |
|---|---|
| Binder resin: | 160 parts |
| Ethyl acetate: | 233 parts |
| Aqueous sodium hydroxide solution (0.3N): | 0.1 part |

The above components are put in a 1000 ml separable flask, followed by heating at 70° C., and the resultant is stirred with a Three-One motor (manufactured by Shinto Scientific Co., Ltd.), thereby preparing a resin mixture solution. While this resin mixture solution is further stirred at 90 rpm, 373 parts of ion exchange water is slowly added thereto to cause phase inversion emulsification, and the solvent is removed, thereby obtaining a resin particle dispersion (B1) (solid content concentration: 30%). The volume average particle diameter of the resin particles in the resin particle dispersion is 162 nm.

Preparation of Brilliant Pigment Dispersion (B1)

| | |
|---|---|
| Aluminum pigment (flake-shaped brilliant pigment, 2173EA, manufactured by Showa Aluminum Powder K.K.): | 100 parts |
| Anionic surfactant (NEOGEN R, manufactured by DAI-ICHI KOGYO SEIYAKU CO., LTD.): | 1.5 parts |
| Ion exchange water: | 900 parts |

The above components are mixed and dissolved, and dispersed using an emulsification dispersing machine CAVITRON (CR 1010, manufactured by Pacific Machinery & Engineering Co., Ltd.) for about 1 hour. As a result, a brilliant pigment dispersion (B1) (solid content concentration: 10%), in which brilliant pigment particles (aluminum pigment particles) are dispersed, is prepared.

Preparation of Release Agent Dispersion (B1)

| | |
|---|---|
| Carnauba wax (RC-160, manufactured by TOA KASEI CO., LTD.): | 50 parts |

-continued

| | |
|---|---|
| Anionic surfactant (NEOGEN RK, manufactured by DAI-ICHI KOGYO SEIYAKU CO., LTD.): | 1.0 part |
| Ion exchange water: | 200 parts |

The above components are mixed and heated to 95° C., and dispersed using a homogenizer (ULTRA TURRAX T50, manufactured by IKA). Thereafter, the resultant is dispersed for 360 minutes by using a MANTON-GAULIN high pressure homogenizer (manufactured by Gaulin Corporation), thereby preparing a release agent dispersion (B1) (solid content concentration: 20%) in which release agent particles having a volume average particle diameter of 0.23 μm are dispersed.

Preparation of Layered Inorganic Substance Dispersion (B1)

| | |
|---|---|
| Montmorillonite (layered inorganic substance, trade name: "NANOCLAY NANOMER 1.28E", manufactured by Sigma-Aldrich Corporation, average length in long axis direction = 2.0 μm, aspect ratio = 30 to 60): | 100 parts |
| Anionic surfactant (NEOGEN R, manufactured by DAI-ICHI KOGYO SEIYAKU CO., LTD.): | 1.5 parts |
| Ion exchange water: | 900 parts |

The above components are mixed, melted, and dispersed using an emulsification dispersing machine CAVITRON (CR 1010, manufactured by Pacific Machinery & Engineering Co., Ltd.) for about 1 hour. Thus, a layered inorganic substance dispersion (B1) (solid content concentration: 10%) in which the layered inorganic substance (montmorillonite) is dispersed is obtained.

Example B1

Preparation on of Toner Particles (B1)

| | |
|---|---|
| Resin particle dispersion (B1): | 450 parts |
| Brilliant pigment dispersion (B1): | 365 parts |
| Release agent dispersion (B1): | 50 parts |
| Nonionic surfactant (IGEPAL CA897): | 1.40 parts |

The above materials are put into a 2 L cylindrical stainless-steel container (diameter: 30 cm). Using a homogenizer (ULTRA TURRAX T50, manufactured by IKA), the components are dispersed and mixed for 10 minutes at 4,000 rpm while applying a shearing force. Next, as an aggregating agent, 1.75 parts of a 10% nitric acid aqueous solution of polyaluminum chloride is slowly added dropwise, and the rotation rate of the homogenizer is set to 5,000 rpm to perform dispersing and mixing for 15 minutes to thereby prepare a material dispersion.

Thereafter, the raw material dispersion is put into a polymerization kettle which includes a stirring device using a two-paddle stirring blade (shape of stirring blade: three-wing propeller, size of stirring blade (diameter): 15 cm) and a thermometer, followed by heating with a mantle heater under stirring at 1,200 rpm to promote the growth of aggregated particles at 54° C. At this time, the pH value of the raw material dispersion is adjusted to a range of 2.2 to 3.5 using 0.3 N nitric acid and 1 N sodium hydroxide aqueous solution. The resultant is held in the above pH value range for about 2 hours and aggregated particles are formed.

Next, 43.2 parts of the layered inorganic substance dispersion (B1) and 100 parts of the resin particle dispersion (B1) are further added thereto so that the resin particles of the binder resin are allowed to adhere to the surfaces of the aggregated particles. The temperature is further raised to 56° C., and the aggregated particles are adjusted while observing the size and the forms of the particles with an optical microscope and a COULTER MULTISIZER II. Subsequently, in order to cause the aggregated particles to coalesce, the pH value is increased to 8.0 and then the temperature is raised to 67.5° C. After the coalescence of the aggregated particles is confirmed with the optical microscope, the pH value is decreased to 6.0 while maintaining the temperature of 67.5° C. After 1 hour, heating is stopped and the particles are cooled at a temperature decreasing rate of 0.1° C./min. The particles are then sieved through a 20 μm mesh, repeatedly washed with water, and then dried in a vacuum dryer. As a result, toner particles (B1) are obtained.

The obtained toner particles have a volume average particle diameter of 12.2 μm.

Preparation of Brilliant Toner (B1) 100 parts of the toner particles (B1), 1.5 parts of hydrophobic silica (RY50, manufactured by Nippon Aerosil Co., Ltd.) and 1.0 part of hydrophobic titanium oxide (T805, manufactured by Nippon Aerosil Co., Ltd.) are mixed using a sample mill at 10,000 rpm for 30 seconds. Thereafter, the particles are then sieved with a vibration sieve having an opening of 45 μm, and thus a brilliant toner (B1) is obtained. The existence rate of montmorillonite in the surface layer is 90%.

Example B2

Toner particles (B2) are obtained in the same manner as in the preparation of the toner particles (B1) except that 13 parts of the layered inorganic substance dispersion (B1) before aggregated particles are formed in the preparation of the toner particles (B1) is added and the amount of the layered inorganic substance dispersion (B1) added after aggregated particles are formed is changed to 30.2 parts.

A brilliant toner (B2) is obtained in the same manner as in the preparation of the brilliant toner (B1) except that the toner particles (B2) are used. The existence rate of montmorillonite in the surface layer is 85%.

Example B3

Toner particles (B3) are obtained in the same manner as in the preparation of the toner particles (B1) except that the amount of the layered inorganic substance dispersion (B1) in the preparation of the toner particles (B1) is changed to 21.6 parts.

A brilliant toner (B3) is obtained in the same manner as in the preparation of the brilliant toner (B1) except that the toner particles (B3) are used. The existence rate of montmorillonite in the surface layer is 91%.

Example B4

Toner particles (B4) are obtained in the same manner as in the preparation of the toner particles (B1) except that 2.2 parts of the layered inorganic substance dispersion (B1) before aggregated particles are formed in the preparation of the toner particles (B1) is added and the amount of the layered inorganic substance dispersion (B1) added after aggregated particles are formed is changed to 19.4 parts.

A brilliant toner (B4) is obtained in the same manner as in the preparation of the brilliant toner (B1) except that the toner particles (B4) are used. The existence rate of montmorillonite in the surface layer is 87%.

Example B5

Toner particles (B5) are obtained in the same manner as in the preparation of the toner particles (B1) except that the amount of the layered inorganic substance dispersion (B1) in the preparation of the toner particles (B1) is changed to 0.108 parts.

A brilliant toner (B5) is obtained in the same manner as in the preparation of the brilliant toner (B1) except that the toner particles (B5) are used. The existence rate of montmorillonite in the surface layer is 87%.

Example B6

Toner particles (B6) are obtained in the same manner as in the preparation of the toner particles (B1) except that 0.032 parts of the layered inorganic substance dispersion (B1) before aggregated particles are formed in the preparation of the toner particles (B1) is added and the amount of the layered inorganic substance dispersion (B1) added after aggregated particles are formed is changed to 0.076 parts.

A brilliant toner (B6) is obtained in the same manner as in the preparation of the brilliant toner (B1) except that the toner particles (B6) are used. The existence rate of montmorillonite in the surface layer is 83%.

Comparative Example B1

Comparative toner particles (B1) are obtained in the same manner as in the preparation of the toner particles (B1) except that the amount of the layered inorganic substance dispersion (B1) in the preparation of the toner particles (B1) is changed to 47.5 parts.

A comparative brilliant toner (B1) is obtained in the same manner as in the preparation of the brilliant toner (B1) except that the comparative toner particles (B1) are used. The existence rate of montmorillonite in the surface layer is 76%.

Comparative Example B2

Comparative toner particles (B2) are obtained in the same manner as in the preparation of the toner particles (B1) except that the amount of the layered inorganic substance dispersion (B1) in the preparation of the toner particles (B1) is changed to 0.022 parts.

A comparative brilliant toner (B2) is obtained in the same manner as in the preparation of the brilliant toner (B1) except that the comparative toner particles (B2) are used. The existence rate of montmorillonite in the surface layer is 93%.

Example B7

Toner particles (B7) are obtained in the same manner as in the preparation of the toner particles (B1) except that as the layered inorganic substance, hydrotalcite used in Example A7 is used in the preparation of the toner particles (B1).

A brilliant toner (B7) is obtained in the same manner as in the preparation of the brilliant toner (B1) except that the toner particles (B7) are used. The existence rate of hydrotalcite in the surface layer is 80%.

Example C: Example of Brilliant Toner Prepared by Dissolution and Suspension Method Preparation of Polyester Resin (C1)

| | |
|---|---|
| Terephthalic acid: | 1,243 parts |
| Ethylene oxide adduct of Bisphenol A: | 1,830 parts |
| Propylene oxide adduct of Bisphenol A: | 840 parts |

The above components are mixed and heated at 180° C., and then 3 parts of dibutyltin oxide is added thereto. The mixture is heated at 220° C. to distill away water, and thus an unmodified polyester resin is obtained. The glass transition temperature Tg of the obtained unmodified polyester resin is 60° C., the acid value is 3 mgKOH/g, and the hydroxyl value is 1 mgKOH/g.

Preparation of Brilliant Pigment Dispersion (C1)

| | |
|---|---|
| Aluminum pigment (flake-shaped brilliant pigment, 2173EA, manufactured by Showa Aluminum Powder K.K.): | 100 parts |
| Ethyl acetate: | 500 parts |

The above components are mixed, the mixture is filtered, and 500 parts of ethyl acetate is further mixed. This operation is repeated 5 times and then the resultant mixture is dispersed using an emulsification dispersing machine CAVITRON (CR1010, manufactured by Pacific Machinery & Engineering Co., Ltd.) for about 1 hour. Thus, a brilliant pigment dispersion (C1) (solid content concentration: 10%) in which a brilliant pigment (aluminum pigment) is dispersed is obtained.

Preparation of Release Agent Dispersion (C1)

| | |
|---|---|
| Paraffin wax (melting temperature: 89° C.): | 30 parts |
| Ethyl acetate: | 270 parts |

The above components are wet-pulverized by a microbead disperser (DCP mill) in a state of being cooled to 10° C. to obtain a release agent dispersion (C1).

Preparation of Oil Phase Liquid (C1)

| | |
|---|---|
| Polyester resin (C1): | 136 parts |
| Brilliant pigment dispersion (C1): | 500 parts |
| Ethyl acetate: | 56 parts |

The above components are stirred and mixed, and then 75 parts of the release agent dispersion (C1) is added to the obtained mixture, followed by stirring. Thus, an oil phase liquid (C1) is obtained.

Preparation of Layered Inorganic Substance Dispersion (C1)

| | |
|---|---|
| Smectite (layered inorganic substance, trade name: "LUCENTITE", manufactured by Co-op Chemical Co., Ltd., average length in long axis direction = 50 nm): | 10 parts |
| Ethyl acetate: | 50 parts |

The above components are mixed, the mixture is filtered, and 40 parts of ethyl acetate is further mixed. This operation is repeated 5 times and then the mixture is dispersed using an emulsification dispersing machine CAVITRON (CR 1010, manufactured by Pacific Machinery & Engineering Co., Ltd.) for about 1 hour. Thus, a layered inorganic substance dispersion (C1) (solid content concentration: 10.0%) in which the layered inorganic substance (smectite) is dispersed is obtained.

Preparation of Layered Inorganic Substance Dispersion (C2)

A layered inorganic substance dispersion (C2) is obtained in the same manner as in the preparation of the layered inorganic substance dispersion (C1) except that smectite used in the layered inorganic substance dispersion (C1) is treated with a 1.0% silicone oil.

Preparation of Styrene Acryl Resin Particle Dispersion (C1)

| | |
|---|---|
| Styrene: | 370 parts |
| n-Butyl acrylate: | 30 parts |
| Acrylic acid: | 4 parts |
| Dodecanthiol: | 24 parts |
| Carbon tetrabromide: | 4 parts |

A mixture obtained by mixing and melting above components is dispersed in an aqueous solution in which 6 parts of a nonionic surfactant (NONIPOL 400, manufactured by Sanyo Chemical Industries, Ltd.) and 10 parts of an anionic surfactant (NEOGEN SC, manufactured by DAI-ICHI KOGYO SEIYAKU CO., LTD.) are dissolved in 560 parts of ion exchange water, and the dispersion is emulsified in a flask. Then, while mixing the components for 10 minutes, an aqueous solution in which 4 parts of ammonium persulphate is dissolved in 50 parts of ion exchange water is added thereto, and the flask is purged with nitrogen. Then, the content in the flask is heated in an oil bath, while stirring, until the temperature reaches 70° C., and allowed to perform emulsion polymerization for 5 hours. Thus, a styrene acryl resin particle dispersion (C1) obtained by dispersing resin particles having an average particle diameter of 180 nm and a weight average molecular weight (Mw) of 15,500 (resin particle concentration: 40% by weight) is obtained. The glass transition temperature of the styrene acryl resin particles is 59° C.

Preparation of Water Phase Liquid (C1)

| | |
|---|---|
| Styrene acryl resin particle dispersion (C1): | 60 parts |
| 2% Aqueous CEROGEN BS-H solution (manufactured by DAI-ICHI KOGYO SEIYAKU CO., LTD.): | 200 parts |
| Ion exchange water: | 200 parts |

The above components are stirred and mixed to obtain a water phase liquid (C1).

Example C1

Preparation of Toner Particles (C1)

300 parts of the oil phase liquid (C1) and 61.2 parts of the layered inorganic substance dispersion (C1) are put into a container, followed by stirring for 2 minutes using a homogenizer (ULTRA TURRAX, manufactured by IKA). Thus, an oil phase liquid (C1P) is obtained. Thereafter, 1,000 parts of the water phase liquid (C1) is added to the container, followed by stirring for 20 minutes using the homogenizer. Next, the mixed solution is stirred for 48 hours at room temperature (25° C.) and normal pressure (1 atmosphere) with a propeller-type stirrer, and the organic solvent is removed to form a particulate material. Next, the particulate material is washed with water, dried and classified to obtain toner particles (C1). The volume average particle diameter of the toner particles is 12 μm.

Preparation of Brilliant Toner (C1) 100 parts of the toner particles (C1), 1.5 parts of hydrophobic silica (RY50, manufactured by Nippon Aerosil Co., Ltd.) and 1.0 part of hydrophobic titanium oxide (T805, manufactured by Nippon Aerosil Co., Ltd.) are mixed using a sample mill at 10,000 rpm for 30 seconds. Thereafter, the particles are then sieved with a vibration sieve having an opening of 45 μm, and thus a brilliant toner (C1) is obtained. The existence rate of smectite in the surface layer is 88%.

Example C2

Toner particles (C2) are obtained in the same manner as in the preparation of the toner particles (C1) except that the layered inorganic substance dispersion (C1) in the preparation of the toner particles (C1) is changed to the layered inorganic substance dispersion (C2).

A brilliant toner (C2) is obtained in the same manner as in the preparation of the brilliant toner (C1) except that the toner particles (C2) are used. The existence rate of smectite in the surface layer is 81%.

Example C3

Toner particles (C3) are obtained in the same manner as in the preparation of the toner particles (C1) except that the amount of the layered inorganic substance dispersion (C1) in the preparation of the toner particles (C1) is changed to 30.6 parts.

A brilliant toner (C3) is obtained in the same manner as in the preparation of the brilliant toner (C1) except that the toner particles (C3) are used. The existence rate of smectite in the surface layer is 89%.

Example C4

Toner particles (C4) are obtained in the same manner as in the preparation of the toner particles (C1) except that the amount of the layered inorganic substance dispersion (C2) in the preparation of the toner particles (C2) is changed to 30.6 parts.

A brilliant toner (C4) is obtained in the same manner as in the preparation of the brilliant toner (C1) except that the toner particles (C4) are used. The existence rate of smectite in the surface layer is 81%.

Example C5

Toner particles (C5) are obtained in the same manner as in the preparation of the toner particles (C1) except that the amount of the layered inorganic substance dispersion (C1) in the preparation of the toner particles (C1) is changed to 0.15 parts.

A brilliant toner (C5) is obtained in the same manner as in the preparation of the brilliant toner (C1) except that the toner particles (C5) are used. The existence rate of smectite in the surface layer is 91%.

Example C6

Toner particles (C6) are obtained in the same manner as in the preparation of the toner particles (C1) except that the amount of the layered inorganic substance dispersion (C2) in the preparation of the toner particles (C2) is changed to 0.15 parts.

A brilliant toner (C6) is obtained in the same manner as in the preparation of the brilliant toner (C1) except that the toner particles (C6) are used. The existence rate of smectite in the surface layer is 80%.

Comparative Example C1

Comparative toner particles (C1) are obtained in the same manner as in the preparation of the toner particles (C1) except that the amount of the layered inorganic substance dispersion (C1) in the preparation of the toner particles (C1) is changed to 67.3 parts.

A comparative brilliant toner (C1) is obtained in the same manner as in the preparation of the brilliant toner (C1) except that the comparative toner particles (C1) are used. The existence rate of smectite in the surface layer is 77%.

Comparative Example C2

Comparative toner particles (C2) are obtained in the same manner as in the preparation of the toner particles (C1) except that the amount of the layered inorganic substance dispersion (C1) in the preparation of the toner particles (C1) is changed to 0.031 parts.

A comparative brilliant toner (C2) is obtained in the same manner as in the preparation of the brilliant toner (1) except that the comparative toner particles (C2) are used. The existence rate of smectite in the surface layer is 92%.

Measurement and Evaluation

Measurement of Existence Rate of Layered Inorganic Substance in Surface Layer

The existence rate of the layered inorganic substance in the surface layer (the ratio of the layered inorganic substance present in a portion being in a range of 5 nm to 20 nm from the surface of the toner particle to the total layered inorganic substance) of each of the brilliant toners obtained in the respective examples is measured according to the aforementioned method. The results are shown in Table 1.

Preparation of Developer 36 parts of the brilliant toner obtained in each example and 414 parts of a carrier are put into a 2 L V blender and stirred for 20 minutes, and the resultant mixture is then sieved with a 212 μm mesh to prepare each developer. As the carrier, a carrier obtained in the following manner is used.

Preparation of Carrier

| | |
|---|---|
| Ferrite particles (volume average particle diameter: 35 μm): | 100 parts |
| Toluene: | 14 parts |
| Methyl methacrylate-perfluorooctyl ethyl acrylate copolymer (critical surface tension: 24 dyn/cm): | 1.6 parts |
| Carbon black (trade name: VXC-72, manufactured by Cabot Corporation, volume resistivity: 100 Ωcm or less): | 0.12 parts |
| Cross-linked melamine resin particles (average particle diameter: 0.3 μm, insoluble in toluene): | 0.3 parts |

First, the carbon black is diluted with the toluene and added to the methyl methacrylate-perfluorooctyl ethyl acrylate copolymer, followed by dispersion with a sand mill. Next, in the resultant, the above components other than the ferrite particles are dispersed with a stirrer for 10 minutes. Thus, a coating layer forming solution is prepared. Next, the coating layer forming solution and the ferrite particles are put into a vacuum degassing kneader, followed by stirring at a temperature of 60° C. for 30 minutes. Then, the pressure is reduced and the toluene is removed by distillation to form a resin coating layer. Thus, a carrier is obtained.

Evaluation

A developer unit of a modified machine of "COLOR 800 PRESS" manufactured by Fuji Xerox Co., Ltd. is filled with the obtained developer.

Using the modified machine, a belt-shaped solid image with an amount of the brilliant toner applied of 4.5 g/m$^2$ is printed on 10,000 sheets of OK TOPCOAT PAPER (paper weight: 127, manufactured by Oji Paper Co., Ltd.).

Brilliance: Measurement of Ratio (X/Y)

The solid image printed on the 10,000th sheet is irradiated with incident light at an incident angle of −45° with respect to the solid image using a spectro-goniophotometer GC 5000L (manufactured by Nippon Denshoku Industries Co., Ltd.) as a goniophotometer, and a reflectance X at a light-receiving angle of +30° and a reflectance Y at a light-receiving angle of −30° are measured. In addition, the reflectances X and Y are respectively obtained by performing measurement with light in a wavelength range of 400 nm to 700 nm at intervals of 20 nm and calculating the average value of reflectances of the respective wavelengths. The ratio (X/Y) is calculated from the measurement results. The results are shown in Table 1.

As the ratio (X/Y) becomes higher, the brilliance becomes higher. As the ratio (X/Y) becomes lower, the dull effect becomes stronger and the brilliance is less likely to be exhibited.

Observation of Surface Damage of Fixing Member

The surface of the fixing member (fixing belt) of the modified machine before and after 10,000 sheets of belt-shaped solid images are printed is observed and evaluation is performed based on the following evaluation criteria. The results are shown in Table 1.

G4: The condition of the surface of the fixing belt is rarely changed before and after image print.

G3: Slight damages with a depth of about 1 mm to 2 mm are observed in several sites on the surface of the fixing belt after image print. However, no damage is reflected on the image.

G2: Damages with a depth of about 1 mm to 2 mm are observed at several sites on the surface of the fixing belt after image print. The damages are reflected at 1 to 5 sites on the image.

G1: Damages are confirmed at 6 or more sites on the image after image print.

TABLE 1

| | Toner | | | | Evaluation | |
|---|---|---|---|---|---|---|
| | | Content of layered inorganic substance (% by weight) | Existence rate of layered inorganic substance in Surface layer (% by weight) | Presence or absence of urea-modified polyester resin | Ratio (X/Y) | Surface damage of fixing member |
| Example A1 | A1 | 2.0 | 91% | Presence | 2.9 | G4 |
| Example A2 | A2 | 2.0 | 82% | Presence | 2.5 | G3 |
| Example A3 | A3 | 1.0 | 92% | Presence | 5.5 | G4 |
| Example A4 | A4 | 1.0 | 81% | Presence | 5.1 | G3 |
| Example A5 | A5 | 0.005 | 94% | Presence | 1.8 | G3 |
| Example A6 | A6 | 0.005 | 83% | Presence | 1.5 | G2 |
| Comparative Example A1 | Comparative A1 | 2.2 | 78% | Presence | 1.1 | G4 |
| Comparative Example A2 | Comparative A2 | 0.001 | 95% | Presence | 1.2 | G1 |
| Example A7 | A7 | 2.0 | 85% | Presence | 2.7 | G3 |
| Example B1 | B1 | 2.0 | 90% | Absence | 2.8 | G4 |
| Example B2 | B2 | 2.0 | 85% | Absence | 2.7 | G3 |
| Example B3 | B3 | 1.0 | 91% | Absence | 2.9 | G4 |
| Example B4 | B4 | 1.0 | 87% | Absence | 2.8 | G3 |
| Example B5 | B5 | 0.005 | 87% | Absence | 2.8 | G3 |
| Example B6 | B6 | 0.005 | 83% | Absence | 1.5 | G2 |
| Comparative Example B1 | Comparative B1 | 2.2 | 76% | Absence | 1.1 | G4 |
| Comparative Example B2 | Comparative B2 | 0.001 | 93% | Absence | 5.9 | G1 |
| Example B7 | B7 | 2.0 | 80% | Absence | 2.8 | G3 |
| Example C1 | C1 | 2.000 | 88% | Absence | 2.8 | G3 |
| Example C2 | C2 | 2.000 | 81% | Absence | 2.5 | G2 |
| Example C3 | C3 | 1.000 | 89% | Absence | 3.0 | G3 |
| Example C4 | C4 | 1.000 | 81% | Absence | 2.2 | G2 |
| Example C5 | C5 | 0.005 | 91% | Absence | 3.1 | G2 |
| Example C6 | C6 | 0.005 | 80% | Absence | 1.9 | G2 |
| Comparative Example C1 | Comparative C1 | 2.2 | 77% | Absence | 1.1 | G4 |
| Comparative Example C2 | Comparative C2 | 0.001 | 92% | Absence | 3.2 | G1 |

From the above results, it is found that in Examples, compared to Comparative Examples, the fixing member is prevented from being damaged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

toner particles that include:

a binder resin, a flake-shaped brilliant pigment, and a layered inorganic substance, wherein:

a content of the layered inorganic substance is from 0.005% by weight to 2.0% by weight with respect to the toner particles, and 80% by weight or more of the total layered inorganic substance is present in a portion being in a range of 5 nm to 20 nm from surfaces of the toner particles.

2. The brilliant toner according to claim 1, wherein the layered inorganic substance is montmorillonite.

3. The brilliant toner according to claim 1, wherein the binder resin contains a urea-modified polyester resin.

4. The brilliant toner according to claim 1, wherein:

the toner particles have a flake shape, and an average equivalent circle diameter D of the toner particles is larger than an average thickness C of the toner particles.

5. The brilliant toner according to claim 1, wherein a ratio (C/D) of the average thickness C of the toner particles to the average equivalent circle diameter D of the toner particles of the brilliant toner is in a range of 0.001 to 0.200.

6. The brilliant toner according to claim 1, wherein the content of the layered inorganic substance is in a range of 0.01% by weight to 1.0% by weight with respect to the toner particles.

7. The brilliant toner according to claim 1, wherein an average length of the layered inorganic substance in a long axis direction is in a range of 0.1 μm to 3 μm.

8. The brilliant toner according to claim 1, wherein 90% by weight or more of the total layered inorganic substance is present in a portion being in a range of 5 nm to 20 nm from the surfaces of the toner particles.

9. An electrostatic charge image developer comprising:

a carrier; and the brilliant toner according to claim 1.

10. A toner cartridge which is detachable from an image forming apparatus comprising:

a storing portion that stores the brilliant toner according to claim 1.

11. The brilliant toner according to claim 1, wherein an average length of the layered inorganic substance in a long axis direction is in a range of 50 nm to 2.0 μm.

12. The brilliant toner according to claim 1, wherein an average aspect ratio of the layered inorganic substance is in a range of 30 to 60.

* * * * *